US005798700A

United States Patent [19]

Wong

[11] Patent Number: 5,798,700

[45] Date of Patent: *Aug. 25, 1998

[54] FALSE ALARM RESISTANT FIRE DETECTOR WITH IMPROVED PERFORMANCE

[75] Inventor: Jacob Y. Wong, Santa Barbara, Calif.

[73] Assignee: Engelhard Sensor Technologies, Inc., Iselin, N.J.

[ * ] Notice: The term of this patent shall not extend beyond the expiration date of Pat. No. 5,592,147.

[21] Appl. No.: 744,040

[22] Filed: Nov. 5, 1996

Related U.S. Application Data

[63] Continuation of Ser. No. 77,488, Jun. 14, 1993, Pat. No. 5,592,147.

[51] Int. Cl.[6] ..... G08B 19/00

[52] U.S. Cl. ..... 340/628; 340/522; 340/577; 340/587; 340/632

[58] Field of Search ..... 340/522, 577, 340/587, 628, 632, 528, 507, 578, 579; 250/381, 384

[56] References Cited

U.S. PATENT DOCUMENTS

| | | | |
|---|---|---|---|
| 3,922,656 | 11/1975 | Horvath et al. | 340/237 |
| 4,093,867 | 6/1978 | Shah et al. | 250/576 |
| 4,186,390 | 1/1980 | Enemark | 340/630 |
| 4,490,715 | 12/1984 | Kusanagi et al. | 340/634 |
| 4,638,304 | 1/1987 | Kimura et al. | 340/500 |
| 4,640,628 | 2/1987 | Seki et al. | 374/141 |
| 4,688,021 | 8/1987 | Buck et al. | 340/521 |
| 4,763,115 | 8/1988 | Cota | 340/628 |
| 4,833,450 | 5/1989 | Buccola et al. | 340/506 |
| 5,026,992 | 6/1991 | Wong | 250/343 |
| 5,053,754 | 10/1991 | Wong | 340/632 |
| 5,079,422 | 1/1992 | Wong | 250/343 |
| 5,100,479 | 3/1992 | Wise et al. | 136/225 |
| 5,103,096 | 4/1992 | Wong | 250/343 |
| 5,159,315 | 10/1992 | Schultz et el. | 340/539 |
| 5,163,332 | 11/1992 | Wong | 73/863.23 |
| 5,276,434 | 1/1994 | Brooks et al. | 340/632 |
| 5,341,214 | 8/1994 | Wong | 356/437 |
| 5,369,397 | 11/1994 | Wong | 340/632 |
| 5,376,924 | 12/1994 | Kubo et al. | 340/632 |
| 5,526,280 | 6/1996 | Consadori et al. | 364/496 |
| 5,592,147 | 1/1997 | Wong | 340/628 |

*Primary Examiner*—Jeffery Hofsass
*Assistant Examiner*—Daniel J. Wu
*Attorney, Agent, or Firm*—Lyon & Lyon LLP

[57] ABSTRACT

A fire detector having a greatly reduced frequency of generating false alarms. An AND gate is responsive to outputs from first and second fire detector modules that are responsive to the detection of first and second characteristics of a fire, respectively, to signal the detection of a fire if both of these characteristics have been detected. At least one override path is included to enable the occurrence of a particular type of fire to be signaled that would not otherwise be signaled by the output of said AND gate.

7 Claims, 1 Drawing Sheet

FALSE ALARM RESISTANT FIRE DETECTOR WITH IMPROVED PERFORMANCE

This application is a continuation of U.S. patent application Ser. No. 08/077,488, filed Jun. 14, 1993, now U.S. Pat. No. 5,592,147, issued Jan. 7, 1997, the contents of which are incorporated herein by reference.

CONVENTION REGARDING REFERENCE NUMERALS

In the figures, each element indicated by a reference numeral will be indicated by the same reference numeral in every figure in which that element appears. The first digit of any reference numeral indicates the first figure in which its associated element is presented.

BACKGROUND OF THE INVENTION

Fire detectors have been widely installed in both commercial buildings and residential structures, such as homes and apartments, to protect the inhabitants and/or other contents located within these structures. These fire detectors are generally of one of the following three types: flame detector; thermal detector; or smoke detector. These three classes of detectors correspond to the three primary properties of a fire: flame, heat and smoke.

Flame Detectors: A flame detector responds to the optical energy radiated from a fire and typically responds to the nonvisible wavelengths. A first class of these detectors operates in the ultraviolet (UV) region below 4,000 Å and a second class of these detectors operates in the infrared region above 7,000 Å. To prevent false alarms from other sources of UV or infrared light, these detectors are constructed to respond only to radiation. In one of these two regions which varies in intensity at a frequency characteristic of typical flicker frequencies of flames (i.e., at a frequency in the range from 5 to 30 Hertz).

Although flame detectors exhibit a low rate of false alarms, they are relatively complex and expensive. Thus, these detectors are generally used only for application in which cost is not a significant factor. For example, this type of detector is commonly used in industrial environments, such as in aircraft hangers and nuclear reactor control rooms.

Thermal Detectors: Heat from a fire is dissipated by both maminar and turbulent, convective flow. The convective flow is produced by the rising, hot air and combustion gases within the plume of the fire. The two basic types of thermal detectors are: ones that detect when a threshold temperature has been exceeded. Temperature threshold detectors are reliable, stable and easy to maintain, but are relatively insensitive. This type of detector is rarely used, especially in buildings having high air flow ventilation and air conditioning systems.

Rate-of-rise thermal detectors are typically used only in environments in which any fires will be expected to be fast-burning fires, such as chemical fires. The threshold for these detectors is typically on the order of 15 Fahrenheit degrees per minute. Unfortunately, there is a significant rate of false detections for both of these two types of thermal detectors.

Recently, a third class of thermal detectors has been introduced that indicates the presence of a fire only if both the temperature and rate of rise of the temperature exceed their respective thresholds. Although this eliminates a high fraction of the false detections, it also makes these detectors highly susceptible of failing to detect the actual occurrence of a fire. This requires that the location of these detectors be carefully selected. Because of this, this type of fire detector is seldomly used in residences.

Smoke Detectors: By far, the most widely-used type of fire detector is the smoke detector. These detectors typically respond to both visible and invisible products of combustion. The visible products typically consist of carbon and carbon-rich particles produced by a fire. The invisible products typically have a diameter of less than 5 microns. The two classes of smoke detectors are: photoelectric detectors that respond to visible products of combustion; and ionization type detectors that respond to both visible and invisible combustion products.

For the past two decades, the ionization type smoke detectors have dominated the fire detector market, because they are less complicated and expensive than flame detectors and thermal detectors. In addition, the ionization type detectors can operate for a year on just a single 9-volt battery available in any super market. In a first class of these devices, the ionization is produced by in the region between a pair of electrodes across which a voltage is produced sufficient to ionize gas in that region. In a second class of these devices, the ionization is produced by generation of a high-speed ion, such as an alpha particle through radioactive decay, which is directed through a sample of air within the room to ionize this sample.

Unfortunately, although the low cost of this second class of ionization type smoke detectors has led to their use in over 90% of households, few people would use these detectors if they were not mandated by fire codes, because of their high rate of false alarms. Few things in life are more irritating than having to dash out of a morning shower to turn off a smoke alarm that has been triggered by steam from a hot shower. These detectors are also easily triggered by smoke produced within a kitchen during meal preparation or even by over-zealous dusting. Because of this, a large fraction of such fire detectors are disabled part or all of the time. The problem of false alarms is thus not only irritating, it is dangerous because of the inclination to disable such detectors to avoid these false alarms.

In one class of smoke detectors designed to reduce the rate of occurrence of such false alarms, a heat detector module is also included in such fire detector and an alarm is produced only if the detection thresholds for both the smoke and heat detectors are exceeded. In another analogous hybrid smoke detector that is similarly designed to reduce the rate of occurrence of these false alarms, a flame detector module is also included and an alarm is produced only if the detection thresholds for both the smoke and flame detectors are exceeded.

Although these two hybrid devices do indeed exhibit a reduced rate of false alarms, each does so in a dangerous manner. First, by producing an alarm only when both the smoke and heat detector modules detect the occurrence of a fire or when both the smoke and flame detector modules detect the occurrence of a fire, this roughly doubles the rate of failure of detecting an actual fire. More precisely, the rate of failure of detecting actual fires is equal to the sum of the rates at which either fails to detect an actual fire, minus the rate at which both would concurrently fail to detect such actual fire. This failure rate is therefore almost equal to the sum of the rates of failure of each of these detector modules individually.

Second, even in those cases in which this fire detector successfully detects the occurrence of an actual fire, the alarm is produced only at such time that both detector modules have detected the occurrence of a fire. Therefore these hybrid detectors are each slower to respond than either of its detector modules separately. Thus, again, the benefit of a reduced rate of false alarms is achieved at the cost of reducing performance substantially to the lower of the performance levels of its two types of fire detector modules.

A second problem with the ionization type smoke detectors is the relatively slow speed of detecting a fire. Although the speed can be increased by lowering the detection threshold, this increases the rate of false detection and therefore increases the likelihood that it will be intentionally disabled.

A third problem is the need to locate these detectors carefully to achieve a high rate of detection of fires in a household environment. Because smoke is a complex, sooty molecular cluster that consists mostly of carbon, it is much heavier than air and therefore diffuses relatively slowly. This requires that such detectors be located near likely sources of fire in the household environment so that a fire will be detected promptly.

A fourth problem is that, although smoke usually accompanies a fire, the amount of smoke that is produced varies over a wide range depending on the composition of the material that catches fire. For example, certain plastics, such as polymethylmethacrylate, an oxygenated fuels, such as ethyl alcohol and acetone, produce substantially less smoke than hydrocarbon polymers, such as polyethylene and polystyrene. Indeed, some fuels such as carbon monoxide, formaldehyde, metaldehyde, formic acid and methyl alcohol burn with nonluminous flames and without producing any smoke.

A more indirect problem with ionization detectors is that they typically utilize a radioactive source, such as Americium, as the source of the ionization-producing radiation. Although the amount of such radioactive material in any single detector is very small (typically on the order of tens of milligrams), the half-life of Americium and cobalt-60 (two typical radioactive sources) is over 1,000 years so that, as more and more of these detectors are dumped into our land fills, the more that this can be a problem to future development of these land fills. This can therefore become a problem when tens of millions of these are disposed of every year.

One additional disadvantage of these ionization detectors is that the need for a battery introduces an ongoing cost of maintenance, but more seriously introduces the likelihood that such detectors can become inoperative, because this battery goes dead without such event being realized by the tenant.

An alternate line of fire detectors are based on measurements of the concentration of carbon dioxide. The following three U.S. patents also include circuitry to avoid or at least reduce the occurrence of false alarms. In U.S. Pat. No. 5,053,754 by Jacob Y. Wong entitled *Simple Fire Detector*, 4.26μ light is directed through a sample of room air to measure the concentration of carbon dioxide in this air, because carbon dioxide has a strong absorption peak at this wavelength. Both the concentration and the rate of change of concentration of the carbon dioxide are measured, enabling an alarm to be generated whenever either of these measured values exceeds a respective threshold value. Preferably, an alarm is sounded only if both of these values exceeds its respective threshold value.

In U.S. Pat. No. 5,079,422 by Jacob Y. Wong entitled *Fire Detection System using Spatially Cooperative Multi-Sensor input Technique* a set of N sensors are spaced throughout a large room or unpartitioned building. Comparison of data from different sensors provides information that is unavailable from only a single sensor. The data from each of these sensors and/or the rate of change of such data is used to determine whether a fire has occurred. The use of data from more than one sensor reduces the likelihood of a false alarm.

In U.S. Pat. No. 5,103,096 by Jacob Y. Wong entitled *Rapid Fire Detector*, a black body source produces a light that is directed through a filter that transmits light in two narrow bands at the 4.26 micron absorption band of carbon dioxide and at 2.20 microns at which none of the atmospheric gases has an absorption band. A blackbody source is alternated between two fixed temperatures to produce light directed through ambient gas and through a filter that passes only these two wavelengths of light. In order to avoid false alarms, an alarm is generated only when both the magnitude of the ration of the measured intensities of these two wavelengths of light and the rate of change of this ration are both exceeded.

SUMMARY OF THE INVENTION

In accordance with the illustrated embodiments, a rapid, reliable, low-cost, radioactive-free and long-life fire detector is presented that is substantially free of false detections and yet provides substantially the same sensitivity and reliability of detecting actual fires as is provided by these radioactive fire detectors. This fire detector utilizes the detection of the concentration of carbon dioxide in conjunction with some other indicator of a fire as the primary criterion for the occurrence of a fire. However, this detector also includes the ability to signal the occurrence of a fire if either the $CO_2$ detector module or this second fire detector module separately detects a condition that warrants the generation of a fire alarm. One such condition is that the rate of change of the detected $CO_2$ level exceeds a preselected threshold. A second such condition is that the detected amount of smoke exceeds a preselected level for a preselected duration which is long enough to avoid typical smoke detector false alarms, such as steam from a shower, but is still short enough that the alarm is not delayed unduly.

Accordingly, it is a primary object of this invention to provide an improved apparatus and method for generating a fire alarm through the detection of carbon dioxide and a second condition indicative of the occurrence of a fire.

This and further objects and advantages will be apparent to those skilled in the art in connection with FIG. 1 and the detailed description of the preferred embodiments set forth below.

DESCRIPTION OF THE PREFERRED EMBODIMENTS

Figure 1:
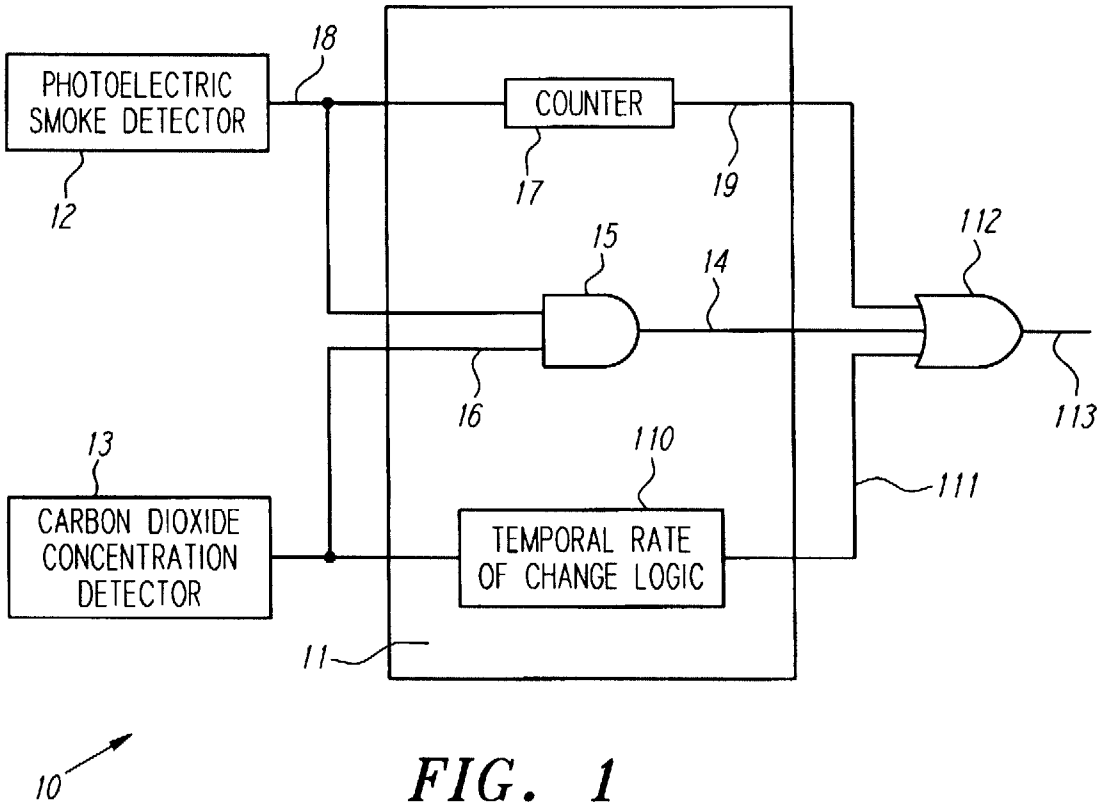
FIG. 1 is a block diagram of a fire detector, having logic circuitry that is responsive to at least two different properties that are each characteristic of the occurrence of a fire, to reduce the frequency of generating false alarms.

FIG. 1 is a block diagram of a fire detector 10 exhibiting a reduced rate of false alarms includes a logic circuit 11 that is responsive to at least two different properties that are each characteristic of the occurrence of a fire, to reduce the frequency of generating false alarms. Fire detector 10 includes a first detector module 12 that detects a first property $P_1$ that is characteristic of the occurrence of a fire and also includes as a second detector module 13 that detects a different (second) property $P_2$ that is also characteristic of the occurrence of a fire. Logic circuitry 11 includes a first output 14 on which binary signal indicates whether or not a fire has been detected. Preferably, logic circuit 11 includes an AND gate 15 that produces a high output signal on first output 14 if and only if the first detector module 12 and second detector module 13 each produces a high output which indicates that it detected the occurrence of a fire.

In a preferred embodiment of this fire detector, the first detector module 12 is a smoke detector that produces a binary high signal if and only if the absorptivity of ambient air exceeds a preselected threshold that is indicative of the occurrence of a fire. This smoke detector can be of any of several different types, including the ionization type of detector that is widely used at the present time and that was discussed above in the Background of the Invention.

The second detector module is a carbon dioxide concentration detector that produces, on an output 16, a binary high signal if and only if the detected concentration of carbon dioxide exceeds a preselected threshold level of carbon dioxide concentration, that is indicative of the occurrence of a fire. This carbon dioxide concentration detector can be of any of several different types, such as the types presented in U.S. Pat. Nos. 5,053,754, 5,079,422, and 5103,096 discussed above in the Background of the Invention.

This arrangement greatly reduces the rate of false alarms signaled on output 14. For example, the false alarms caused by steam from a shower will be suppressed, because the output of the carbon dioxide concentration detector module 13 will be low. Similarly, the false alarms caused, for example, by a sufficient concentration of guests at a party to trigger the carbon dioxide based fire detector module 13 when there in fact is no fire, will be suppressed because the smoke detector module 12 will not be signaling the presence of a fire.

Unfortunately, there are some types of fires in which this arrangement would fail to signal the occurrence of an actual fire. Because it is important to ensure that the suppression of false alarms does not produce a significant likelihood that fires that should be detected are not signaled, because of this false alarm suppression, one or more override conditions are identified which are separately identified as sufficient to indicate the occurrence of a fire and which would not be signaled by the signal on output 14.

Two conditions that have been identified as sufficient indications that a fire has occurred even though the signal on output 14 is low are: the detection of a fire by smoke detector module 12 for a period exceeding some threshold period, such as five minutes; and the detection of a carbon dioxide concentration rate of change exceeding 1,000 parts per million per minute. The first of these two cases occurs for a "cold" fire in which sufficient smoke is produced to trigger smoke detector module 12, but the rate of production of carbon dioxide is insufficient to produce a high signal on the first output of detector module 13. The second of these two cases occurs for a "hot" fire in which a large amount of carbon dioxide is produced, but very little smoke is produced.

It is important to include a pair of override paths that will ensure that both of these conditions will result in the production of an alarm. Therefore, logic circuit 11 includes a counter 17 that is connected to the output 18 of the first fire detector module 12. This counter is activated by a high signal from smoke detector module 12 and is reset to zero each time that the output of the first fire detector becomes low. This counter therefore functions as a clock that measures the duration of each interval in which the output from the smoke detector is high and resets to zero whenever the output of the smoke detector goes low. This counter produces a high signal on a second output 19 of logic circuit 11 if and only if the value of this counter exceeds a preselected threshold level. In particular, this level is selected to correspond to five minutes, so that the signal on output 19 goes high if and only if smoke has been detected for more than 5 minutes.

Logic circuit 11 also includes temporal rate of change detector 110 that is responsive to the output signal from carbon dioxide concentration detector module 13 to measure the temporal rate of change of the output signal from detector module 13 and to produce, on a third output 111 of logic 11, a binary signal that is high if and only if the temporal rate of change of the output signal from the second fire detector module 13 exceeds a preselected threshold, such as 1,000 parts per million per minute.

An OR gate 112 is responsive to the signals on first output 14, second output 19 and third output 111 to produce on its output 113 a binary signal that indicates whether a fire has been detected. The normal event that will produce an indication that a fire has been detected (i.e., a high signal on output 113) is the detection of a fire by both the smoke detector module 12 and the carbon dioxide concentration detector module 13.

Because the carbon dioxide concentration detector module 12 is much faster than the smoke detector module, the detection speed of fire detector 10 is substantially as fast as that of the carbon dioxide concentration module 13. Thus, fire detector 12 exhibits more functionality than conventional smoke detectors (i.e., it also detect "hot" fires) while at the same time substantially eliminating false alarms without significantly delaying the detection of the majority of fires which generate sufficient smoke and carbon dioxide to trigger both fire detector modules 12 and 13.

Alternate preferred embodiments include a hybrid fire detector having a $CO_2$ concentration detector module and/or $CO_2$ concentration rate of change detector module in conjunction with some fire property other than smoke or $CO_2$ concentration. For example, these other embodiments contain a $CO_2$ concentration or $CO_2$ concentrate rate of change detector module in conjunction with a flame detector and/or a heat detector module. In each of these cases, a bypass generates a fire alarm if either the $CO_2$ detector module or its companion fire detector module detects a condition that is sufficient by itself to clearly indicate the occurrence of a fire.

I claim:

1. A fire detector having a low rate of generating false alarms, comprising:

a $CO_2$ fire detector module;

a smoke detector module adapted to measure a second property that is indicative of the presence of a fire;

an AND gate, having an output, having a first input connected to an output of the $CO_2$ fire detector and having a second input connected to an output of the smoke detector module;

a clock, connected to the smoke detector module, for measuring a duration of each interval in which the smoke detector measures a smoke level exceeding a preselected smoke threshold level; and alarm means, responsive to an output of the clock and the output of the AND gate, for producing an alarm if either of the following criteria are met:

the output of the clock exceeds a preselected clock threshold level, thereby indicating that the smoke level has exceeded the preselected smoke threshold level for longer than a preselected interval; or the output of the AND gate is high, indicating that a fire has been detected by both the $CO_2$ detector and the smoke detector.

2. A fire detector having a low rate of generating false alarms, comprising:

a $CO_2$ detector;

a smoke detector; and a logic circuit for generating a fire alarm when either of the following criteria are met:

the $CO_2$ detector and the smoke detector detect two different conditions indicative of the occurrence of a fire at the same time; or a temporal rate of change of carbon dioxide concentration exceeds a preselected threshold.

3. A fire detector as recited in claim 2, wherein the preselected threshold is 1,000 parts per million per minute.

4. A fire detector as recited in claim 2, wherein the logic circuit will also generate the fire alarm if the smoke detector detects one of the two conditions indicative of the occurrence of a fire for a duration exceeding a preselected time period.

5. A method for generating a fire alarm, comprising the steps of:

detecting carbon dioxide concentration;

detecting a second condition indicative of the occurrence of a fire; and signaling the occurrence of a fire when either of the following conditions is met:

carbon dioxide concentration and the second condition are both indicative of the occurrence of a fire; or the temporal rate of change of carbon dioxide concentration exceeds a preselected threshold.

6. A method as recited in claim 5, wherein the preselected threshold is 1,000 parts per million per minute.

7. A method as recited in claim 5, wherein the occurrence of a fire will also be signaled if the second condition is detected for a duration exceeding a preselected time period.

* * * * *